US011587544B2

(12) United States Patent
Zafeiropoulos et al.

(10) Patent No.: US 11,587,544 B2
(45) Date of Patent: Feb. 21, 2023

(54) ACTIVE ROAD NOISE CONTROL

(71) Applicant: Harman Becker Automotive Systems GmbH, Karlsbad (DE)

(72) Inventors: Nikos Zafeiropoulos, Straubing (DE); Gerhard Pfaffinger, Regensburg (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 16/634,848

(22) PCT Filed: Aug. 1, 2017

(86) PCT No.: PCT/EP2017/069407
§ 371 (c)(1),
(2) Date: Jan. 28, 2020

(87) PCT Pub. No.: WO2019/024984
PCT Pub. Date: Feb. 7, 2019

(65) Prior Publication Data

US 2020/0219478 A1 Jul. 9, 2020

(51) Int. Cl.
*G10K 11/178* (2006.01)
*H04R 1/02* (2006.01)
(Continued)

(52) U.S. Cl.
CPC .. *G10K 11/17854* (2018.01); *G10K 11/17873* (2018.01); *G10K 11/17875* (2018.01);
(Continued)

(58) Field of Classification Search
CPC ..... G10K 11/17823; G10K 11/17854; G10K 11/17873; G10K 11/17875;
(Continued)

(56) References Cited

U.S. PATENT DOCUMENTS 9,591,404 B1 * 3/2017 Chhetri ..... H04R 3/005
2006/0188111 A1 * 8/2006 Kihara ..... H04R 1/406 381/92
(Continued)

FOREIGN PATENT DOCUMENTS

CN 201666815 U * 12/2010
EP 3188181 A1 7/2017
(Continued)

OTHER PUBLICATIONS

ISA European Patent Office, International Search Report and Written Opinion Issued in Application No. PCT/EP2017/069407, dated May 4, 2018, WIPO, 10 pages.

*Primary Examiner* — Kile O Blair
(74) *Attorney, Agent, or Firm* — McCoy Russell LLP

(57) ABSTRACT

An active road noise control system method for a vehicle includes picking up noise at a multiplicity of positions in or on the vehicle and generating a multiplicity of noise sense signals representative of road noise originating from a road noise source in or at the vehicle, and processing, according to a beamforming scheme, the multiplicity of noise sense signals to generate a reference signal and to provide a sensitivity characteristic for picking up the noise that comprises one main lobe directed to the road noise source. The system and method further includes iteratively and adaptively processing the reference signal to provide a noise reducing signal, and generating at one or more positions in an interior of the vehicle, from the noise reducing signal, noise reducing sound at a listening position in the interior of the vehicle.

20 Claims, 4 Drawing Sheets

(51) Int. Cl.
*H04R 1/40* (2006.01)
*H04R 3/00* (2006.01)

(52) U.S. Cl.
CPC ..... *G10K 11/17881* (2018.01); *H04R 1/025* (2013.01); *H04R 1/406* (2013.01); *H04R 3/005* (2013.01); *G10K 2210/12821* (2013.01); *G10K 2210/3026* (2013.01); *G10K 2210/3027* (2013.01); *G10K 2210/3028* (2013.01); *G10K 2210/3046* (2013.01); *H04R 2499/13* (2013.01)

(58) Field of Classification Search
CPC ... G10K 11/17881; G10K 2210/12821; G10K 2210/3026; G10K 2210/3027; G10K 2210/3028; G10K 2210/3046; G10K 11/17879; G10K 2210/111; G10K 2210/12; G10K 2210/1282; G10K 2210/3215; G10K 2210/3221; H04R 1/025; H04R 1/406; H04R 2499/13; H04R 3/005; H04R 2410/01
See application file for complete search history.

(56) References Cited

U.S. PATENT DOCUMENTS

2009/0066499 A1* 3/2009 Bai ..... G10K 15/04 340/459
2011/0038229 A1* 2/2011 Beaucoup ..... G01S 3/8083 381/92
2016/0196817 A1* 7/2016 Mortensen ..... G10K 11/17855 381/71.8
2016/0196818 A1* 7/2016 Christoph ..... H04S 7/301 381/71.6
2017/0193975 A1* 7/2017 Butts ..... G10K 11/17823
2017/0278504 A1* 9/2017 Ross ..... G10K 11/17857

FOREIGN PATENT DOCUMENTS

WO 9708683 A1 3/1997
WO 2016143340 A1 9/2016

* cited by examiner

ACTIVE ROAD NOISE CONTROL

CROSS REFERENCE TO RELATED APPLICATIONS

The present application is a U.S. National Phase of International Application No. PCT/EP2017/069407 entitled "ACTIVE ROAD NOISE CONTROL", and filed on Aug. 1, 2017. The entire contents of the above-identified application is hereby incorporated by reference for all purposes.

FIELD

The disclosure relates to active road noise control systems and methods (generally referred to as "systems").

BACKGROUND

Land based vehicles, when driven on roads and other surfaces, generate noise known as road noise. Even in modern vehicles, cabin occupants may be exposed to road noise that is transmitted through the structure, e.g. tires-suspension-body-cabin path, and through airborne paths, e.g. tires-body-cabin path, to the cabin. Active noise, vibration, and harshness (NVH) control technologies, also known as active road noise control (RNC) systems, can be used to reduce these noise components without modifying the vehicle's structure as in active vibration technologies. However, active road noise control technologies may employ complex noise sensor arrangements throughout the vehicle structure in order to properly observe road noise related signals, particularly signals related to road noise originating from moving parts such as rolling wheels. It is desirable to reduce the road noise experienced by cabin occupants more efficiently.

SUMMARY

An active road noise control system for a vehicle includes a noise sensing microphone array at a multiplicity of positions in or on the vehicle and configured to generate a multiplicity of noise sense signals representative of road noise originating from a road noise source in or at the vehicle, the noise sensing microphone array comprising a multiplicity of microphones disposed at a multiplicity of positions in or on the vehicle, and a beamformer configured to process the multiplicity of noise sense signals to generate a reference signal and to provide, in connection with the noise sensing microphone array, a sensitivity characteristic that comprises a main lobe directed to the road noise source. The system further includes an active road noise control filter configured to iteratively and adaptively process the reference signal to provide a noise reducing signal, and a loudspeaker arrangement disposed in an interior of the vehicle and configured to generate, from the noise reducing signal, noise reducing sound at a listening position in the interior of the vehicle, the loudspeaker arrangement comprising one or more loudspeakers.

An active road noise control method for a vehicle includes picking up noise at a multiplicity of positions in or on the vehicle and generating a multiplicity of noise sense signals representative of road noise originating from a road noise source in or at the vehicle, and processing according to a beamforming scheme the multiplicity of noise sense signals to generate a reference signal and to provide a sensitivity characteristic for picking up the noise that comprises a main lobe directed to the road noise source. The method further includes iteratively and adaptively processing the reference signal to provide a noise reducing signal, and generating at one or more positions in an interior of the vehicle, from the noise reducing signal, noise reducing sound at a listening position in the interior of the vehicle.

Other systems, methods, features and advantages will be, or will become, apparent to one with skill in the art upon examination of the following detailed description and appended figures. It is intended that all such additional systems, methods, features and advantages be included within this description, be within the scope of the invention, and be protected by the following claims.

BRIEF DESCRIPTION OF THE DRAWINGS

The disclosure may be better understood by reading the following description of non-limiting embodiments of the attached drawings, in which like elements are referred to with like reference numbers, wherein below.

DETAILED DESCRIPTION

Figure 1:
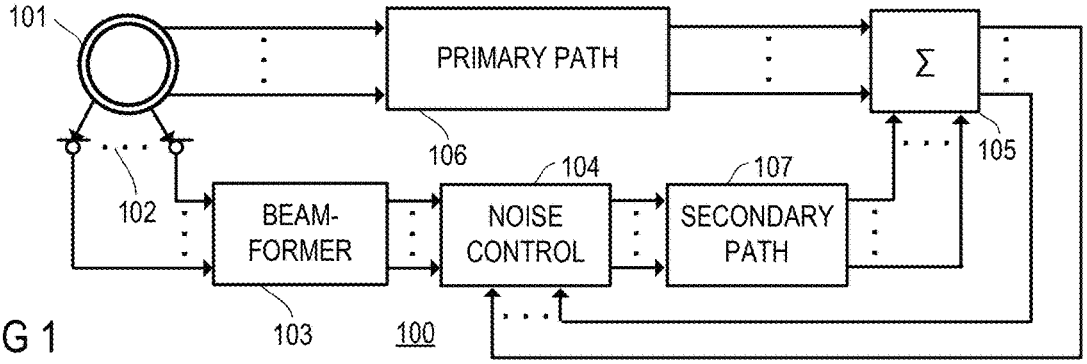
FIG. 1 is a simplified schematic diagram illustrating an exemplary multi-channel active road noise control system utilizing one noise sensing microphone array at a specific position.

Referring to FIG. 1, in an exemplary road noise control system 100 for a vehicle, e.g., an automobile (not shown), airborne road noise from one or more road noise sources 101 is monitored with acoustic sensors or an array of acoustic sensors (herein also referred to as noise sensing arrays or noise sensing microphone arrays) such as, e.g., one or more arrays of noise sensing microphones 102 that each picks up airborne road noise and generates corresponding noise sense signals. The noise sense signals are pre-processed, e.g., with a single or multi-channel beamformer 103, and serve upon pre-processing as one or more reference signals for a road noise control 104. Furthermore, an (optional) arrangement with one or more error microphones 105 may be placed in close proximity of a listening position within an interior of the vehicle, to provide additionally one or more error signals for the road noise control 104. At the arrangement with one or more error microphones 105, the airborne road noise from road noise source 101 transferred via one or more primary paths 106 interferes (is summed up) with noise reducing sound from the noise control 104 transferred via one or more secondary paths 107. The active road noise control 104 may include, e.g., one or more noise reduction filters employed in a feedforward noise control structure or in a structure including a feedforward noise control structure, and may iteratively and adaptively process the one or more reference signals and (optionally) the one or more error signals to provide a noise reducing signal to a loudspeaker arrangement that includes one or more loudspeakers in the interior of the vehicle to generate noise reducing sound. The noise reduction filters may be iteratively and adaptively tuned to achieve maximum noise reduction or noise cancellation so that, at the arrangement with one or more error microphones 105, the airborne road noise from the road noise source 101 transferred via the one or more primary paths 106 is destructively superimposed with the noise reducing sound from noise control 104 transferred via the one or more secondary paths 107.

The noise sensing signals output by the (at least one) noise sensing array, i.e., of the noise sensing microphones thereof, are pre-processed in order to achieve maximum coherence between the output signals of the (at least one) noise sensing array and the sound that occurs at the listening position, e.g., represented by the error signal(s) output by the error microphone(s). Signals are coherent if they have the same frequency and maintain a constant phase offset relative to each other. The (at least one) noise sensing microphone array may have a planar structure, e.g., an octagon or any other regular structure, such that is able to capture the complex radiation pattern of the tire noise.

As already outlined above, active control of airborne road noise employs specific signal pre-processing techniques in combination with acoustic sensor arrays in order to capture the radiating noise pattern from a rolling wheel, e.g., its tire. For example, an acoustic beamforming technique may be employed for pre-processing to more accurately capture the road noise from the wheel so that the coherence between the reference signal(s) and the sound that occurs at the listening position, represented by the error signal(s), can be increased, resulting in an improved road noise control performance, particularly in terms of accuracy and/or frequency range. The exemplary active road noise control also employs specific signal processing for signals related to one or more secondary paths, which allows for creating one or more quiet zones around one (e.g., a passenger's head) or more (e.g., a passenger's ears) listening positions.

Optionally, the system (and the method performed by the system) may further include radiating a noise reducing signal with a headrest loudspeaker arrangement, i.e., one or more loudspeakers that are disposed in a headrest in the interior of the vehicle, to generate noise reducing sound at the one or more listening positions in order to further enhance active road noise control. The noise reducing signal is generated by picking up road noise occurring in or at one or more wheel wells (wheel arches) of the vehicle with one or more noise sensing arrays and by specific pre-processing, e.g., by way of one or more beamforming schemes.

Figure 2:
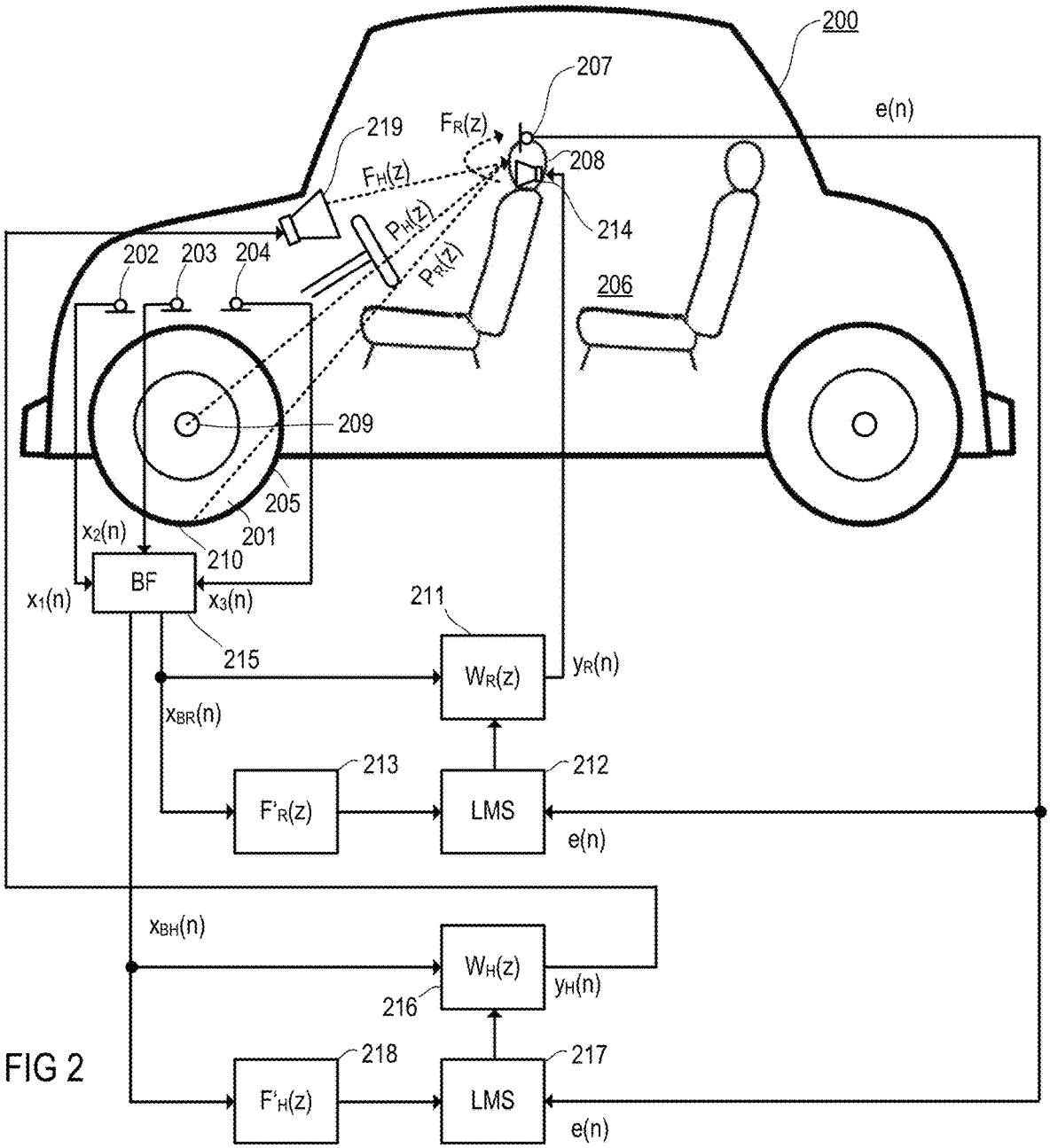
FIG. 2 is a detailed schematic diagram illustrating an exemplary dual-channel active road noise control system utilizing one noise sensing microphone array at another specific position.

Referring to FIG. 2, an exemplary dual-channel feedforward active road noise control system is implemented in a vehicle 200. Noise that originates from a wheel 201 of the vehicle 200 when moving on a road surface (not shown), e.g., noise that originates from the boundary between the wheel 201 and the road (first road noise source), is picked-up by a linear (shown) or planar (not shown) noise sensing microphone array 202-204 which may include three (or any other number of) microphones 202, 203, and 204 and which may be arranged in a line (plane) at an upper position of a wheel arch 205 that encompasses an upper part of the wheel 201. The noise sensing microphone array 202-104 outputs noise sense signals x1(n), x2(n) and x3(n) which represent the picked-up road noise and which corresponds more or less with road noise audible in an interior 206 of the vehicle 200. Further, an error signal e(n) representing noise present in the interior 206 is picked-up by an acoustic sensor, e.g., an error microphone 207 arranged in a headrest 208 of a seat (e.g., a driver's seat) in the interior 206. The seat, particularly its headrest 208, defines a listening position in the interior 206. Road noise originating from a wheel hub 209 is acoustically transferred via an airborne primary path to the error microphone 207 according to a transfer characteristic PH(z). Road noise originating from a boundary 210 between the wheel (tire) and the road is acoustically transferred via another airborne primary path to the error microphone 207 according to a transfer characteristic PR(z).

A transfer characteristic $W_R(z)$ of a controllable filter 211, which receives and filters a reference signal $x_{BR}(n)$, is controlled by an adaptive filter controller 212 which may operate according to the known least mean square (LMS) algorithm based on the error signal e(n) and on the reference signal $x_{BR}(n)$ after optional filtering with a transfer characteristic $F'_R(z)$ by a filter 213, wherein $W_R(z)=-P_R(z)/F'_R(z)$. The transfer function $F'_R(z)$ models (i.e., ideally equals or at least approximates) a transfer function $F_R(z)$ which represents the transfer characteristics between a loudspeaker arrangement 214 and the error microphone 207. The loudspeaker arrangement 214 includes one or more loudspeakers disposed in the headrest (or elsewhere in the interior).

A noise reduction signal $y_R(n)$ that inversely corresponds to noise from the wheel-road boundary audible at the listening position in the interior 206 is generated, based on the identified transfer characteristic $W_R(z)$ and the reference signal $x_{BR}(n)$, by the active road noise control filter arrangement that includes at least the controllable filter 211 and the filter controller 212. From the noise reduction signal $y_R(n)$ sound that is ideally inverse to the road noise that originates from a boundary 210 between the wheel (tire) and the road and that is audible at the listening position is generated to be radiated by the headrest loudspeaker arrangement 214 for destructively superimposing with the road noise audible at the listening position.

Further, sound that originates from elsewhere at the wheel 201, e.g., from the wheel hub 209 (second road noise source), may be picked up by the noise sensing microphone arrangement that includes the noise sensing microphones 212, 213 and 214 (as shown) or another noise sensing microphone arrangement (not shown) disposed elsewhere. A transfer characteristic $W_H(z)$ of a controllable filter 216 is controlled by an adaptive filter controller 217 which may operate according to the known least mean square (LMS) algorithm based on the error signal e(n) and on the reference signal $x_{BH}(n)$ filtered with a transfer characteristic $F'_H(z)$ by an optional filter 218, wherein $W_H(z)=-P_H(z)/F'_H(z)$. The transfer function $F'_M(z)$ models (i.e., is ideally equal to or at least approximates) a transfer function $F_H(z)$ which represents the transfer characteristics between a loudspeaker arrangement 219 and the error microphone 207. The loudspeaker arrangement 219 includes one or more loudspeakers and is disposed somewhere in the interior 206, e.g., dashboard, doors, trunk, rear shelf, etc. or the headrest 208.

A noise reduction signal $y_H(n)$ that inversely corresponds to the noise from the wheel hub audible at the listening position in the interior 206 is generated, based on the identified transfer characteristic $W_H(z)$ and the reference signal $x_{BH}(n)$, by the active road noise control filter arrangement that includes at least the controllable filter 216 and filter controller 217. From the noise reduction signal $y_H(n)$, sound that is ideally inverse to the road noise that originates from the wheel hub noise and that is audible at the listening position is generated to be radiated by the loudspeaker arrangement 219 for destructively superimposing with the road noise at the listening position.

The reference signals xBR(n) and xBH(n) are derived from the noise sense signals x1(n), x2(n), and x3(n), by way of the beamformer 215 or alternatively by two separate beamformers (not shown) that both are supplied with the noise sense signals x1(n), x2(n), x3(n), or with two sets of noise sensing signals from two separate noise sensing arrays (not shown). In the example shown, the beamformer 215 processes the noise sense signals x1(n), x2(n), and x3(n) to generate in combination with the noise sensing array two separately steerable beams, also referred to as main lobes, of a (spatial) sensitivity characteristic. Sensitivity of a sound sensor or sound sensing system is the ratio of an output signal to an input sound pressure. The main lobe is, thus, the directivity pattern of such a sensor or system exhibiting the highest sensitivity, in contrast to side lobes which exhibit lower sensitivities. If optional filters 213, 218 are employed as shown in FIG. 2, a dual-channel feedforward filtered-x LMS control structure is implemented, but other control structures, e.g., any single-channel structures or any other multi-channel structures with additional channels, additional microphones, and additional loudspeakers may be applied as well.

An exemplary implementation of the beamformer 215 is described below with reference to FIG. 3 where road noise is recorded by an array of a multiplicity (i) of microphones 301 (such as, e.g., microphones 202, 203, 204 used in the system shown in FIG. 2) to provide a multiplicity (i) of noise sense signals x1(n), x2(n), . . . , xi(n), i being the number of microphones that form the basis for the beamforming. The noise sense signals x1(n), x2(n), . . . , xi(n) are amplified with a multiplicity (i) of gains a1, a2, . . . , ai by way of a multiplicity (i) of pre-amplifiers 302, and delayed by a multiplicity (i) of delay times $\tau1, \tau2, \ldots, \tau i$ by way of delays 303. The amplified and delayed noise sense signals x1(n), x2(n), . . . , xi(n) are weighted by way of coefficient elements 304 that apply a multiplicity (i) of coefficients c1, c2, . . . , ci, with which the beam (e.g., main lobe) is steered, to the respective input signals, e.g., the noise sense signals x1(n), x2(n), and x3(n), and finally being summed up by way of a summer 305 which provides a reference signal xB(n).

The reference signal xB(n) can be utilized as the reference signal xBR(n) or reference signal xBH(n) in the example described above in connection with FIG. 2. However, the two reference signals xBR(n) and xBH(n) can also be generated at the same time, for example, by employing two beamformers with the same microphone array or different microphone arrays, or providing additional coefficient elements for each amplified and delayed noise sense signals x1(n), x2(n), and x3(n) in combination with an additional summer.

Figure 3:
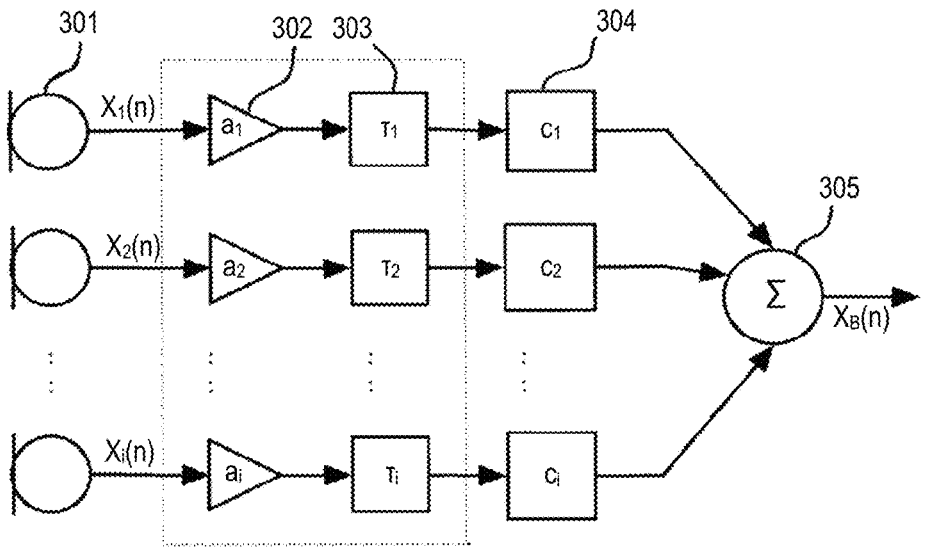
FIG. 3 is a schematic diagram illustrating an exemplary delay and sum beamformer applicable in the systems shown in FIGS. 1 and 2.

In the delay and sum beamformer shown in FIG. 3, the beamformed signal xB(n) is generated according to $xB(n)=(a1\cdot c1\cdot x1(n-\tau1)+a2\cdot c2\cdot x2(n-\tau2)+\ \ldots\ +ai\cdot ci\cdot xi(n-\tau i))/i$, i being the number of microphones that form the basis for the beamforming b; a1, a2, . . . , ai being the gains of the pre-amplifiers that serve to level out gain differences of the i microphones; $\tau1, \tau2, \ldots, Ti$ being the signal delay times; and c1, c2, . . . , ci, being the coefficients with which the beam can be steered. Instead of the pre-amplifiers and/or delays, fixed filters can be used for the synthesis of the reference signals. However, as already mentioned, other beamforming algorithms and methods can be used to generate the reference signals xB(n), xBR(n), and xBH(n).

As described above in connection with FIG. 2, the noise sense signals $x_1(n), x_2(n), \ldots, x_i(n)$ are processed in the beamformer 215 according to a beamforming scheme (e.g, algorithm, process, method, etc.) that allows for separating complex incoherent wheel noise sources. The beamformer 215, which may employ a delay and sum beamforming scheme as described above, a generalized side lobe cancelling scheme or any other suitable scheme, is used for generating the reference signals $x_{BR}(n)$ and $x_{BH}(n)$. Thus, the cancellation of the cross-terms that are generated due to the complex wheel radiation pattern are removed through adequate processing (e.g., beamforming) and, accordingly, the coherence between the reference signals and the error signals at the listening position(s), e.g., passengers' head or ears, is increased.

Figure 4:
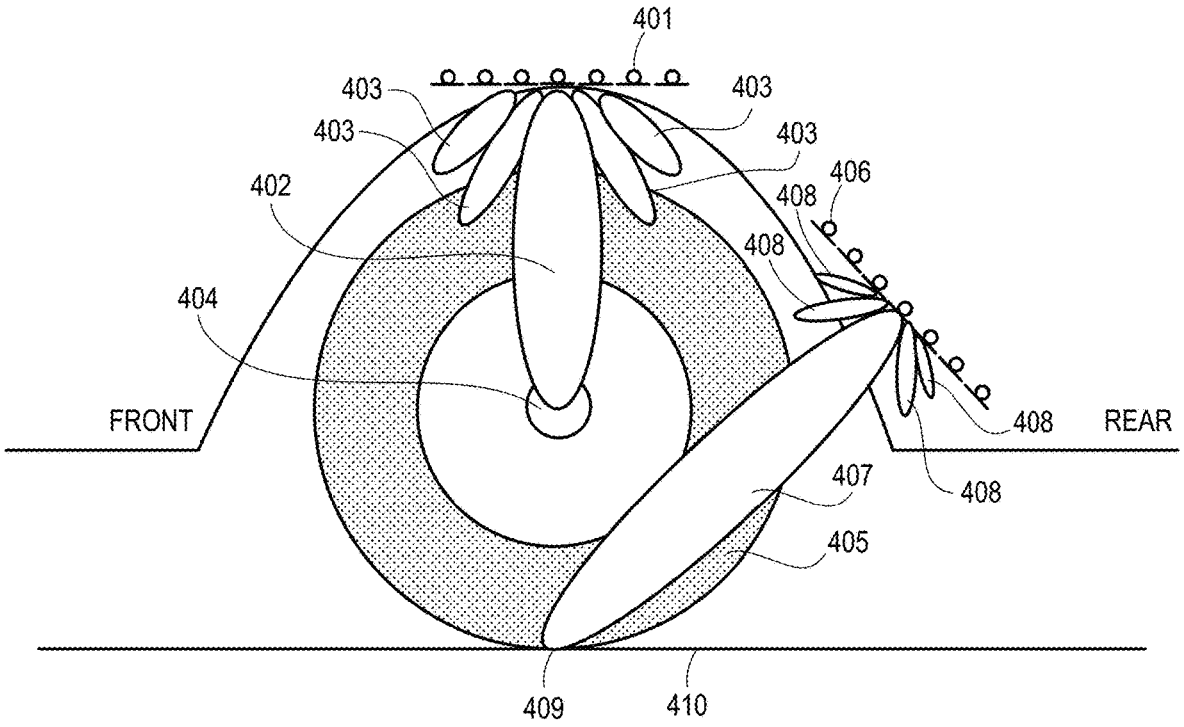
FIG. 4 is a schematic diagram illustrating an exemplary arrangement with two noise sensing microphone arrays disposed at a wheel arch around a wheel.

Referring to FIG. 4, a noise sensing microphone array 401 in combination with a beamformer arrangement (not shown) may provide a sensitivity characteristic that includes a main lobe 402 and a multiplicity of side lobes 403. The main lobe 402 is directed to one noise source, e.g., a hub 404 of a wheel 405. Another noise sensing microphone array 406, in combination with another beamformer arrangement (not shown), may provide a sensitivity characteristic that includes a main lobe 407 and a multiplicity of side lobes 408. The main lobe 407 may be directed to another noise source, e.g., a boundary 409 between the wheel 405 (i.e., its tire) and a road surface 409. The two noise sensing microphone arrays 401 and 407 (e.g., line or planar arrays) may be disposed at or around a wheel arch 411. For example, the noise sensing microphone array 401 may be disposed straight above the wheel 405, and the noise sensing microphone array 407 may be disposed behind the wheel 405.

Figure 5:
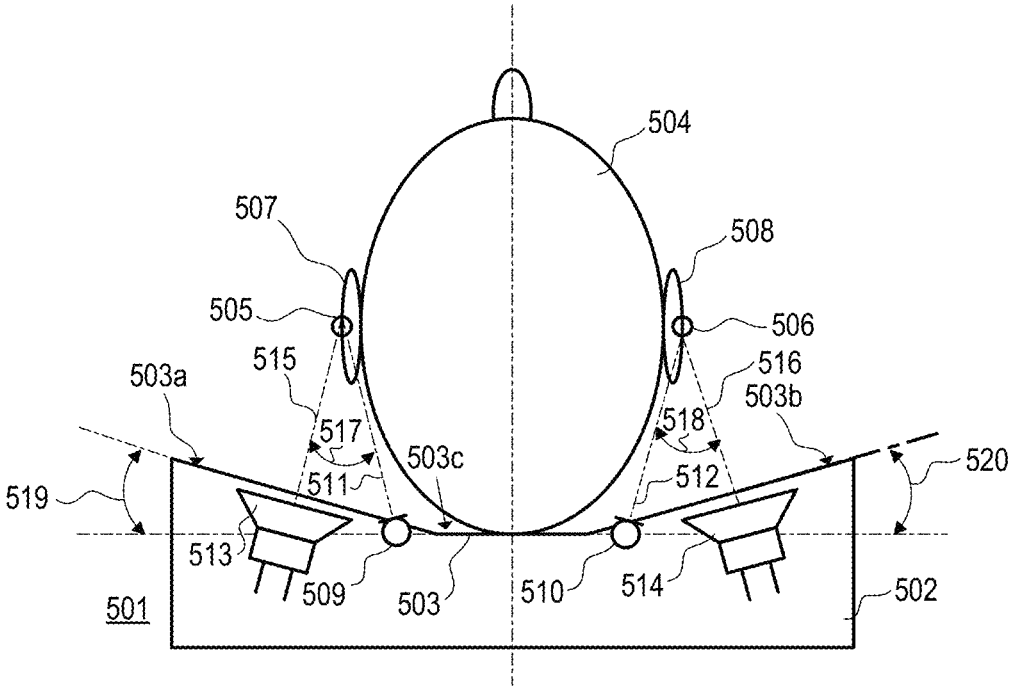
FIG. 5 is a schematic diagram of an exemplary headrest in which microphones and loudspeakers are integrated side by side in a front surface of the headrest, the microphones being arranged towards a center of the headrest and the loudspeakers being arranged towards a periphery of the headrest.

Reference is now made to FIG. 5, which depicts an exemplary headrest 501 in a sectional illustration. Headrest 501 may have a cover and one or more structural elements that form a headrest body 502. Headrest 501 may comprise a pair of support pillars (not shown) that engage the top of a vehicle seat (not shown) and may be movable up and down by way of a mechanism integrated into the seat. Headrest body 502 has front surface 503 that supports a user's head 504, thereby defining preferential positions 505 and 506 of user's ears 507 and 508. Preferential positions are where the respective ear is at or close to this particular position most of the time (>50%) during intended use, and may form desired listening positions at which, for example, quiet zones are to be established.

Two unidirectional (error) microphones 509 and 510, i.e., microphones that have a maximum sensitivity to sounds from principal receiving directions 511 and 512, are integrated in front surface 503 of headrest body 502, whereby principal receiving directions 511 and 512 intersect with one of preferential positions 505 and 506 of a passenger's ears 507 and 508, respectively. Headrest 501 further includes two loudspeakers 513 and 514 integrated in the headrest body 502. Loudspeakers 513 and 514 each have principal transmitting directions 515, 516 into which they radiate maximum sound energy. Headrest 501 has at its surface 503 an inward-curving (concave) shape with two planar end sections 503*a*, 503*b* and a planar intermediate section 503*c* in which the end sections are folded inwards by angles 519 and 520, respectively, of about 30 degrees, but any other angle between 10 and 50 degrees is applicable as well. In each of the end sections, one of microphones 509 and 510 and one of loudspeakers 513 and 514 are positioned. In headrest 501 shown in FIG. 5, loudspeakers 513 and 514 are arranged closer to the outer periphery of the surface 503 than microphones 509 and 510. Loudspeakers 513 and 514 are arranged such that their principal transmitting directions 515 and 516 each have one of angles 517 and 518 at preferential positions 505 and 506 of greater than 20 degree, e.g., 30 degrees with regard to the respective principal receiving directions of microphones 509 and 510.

Figure 6:
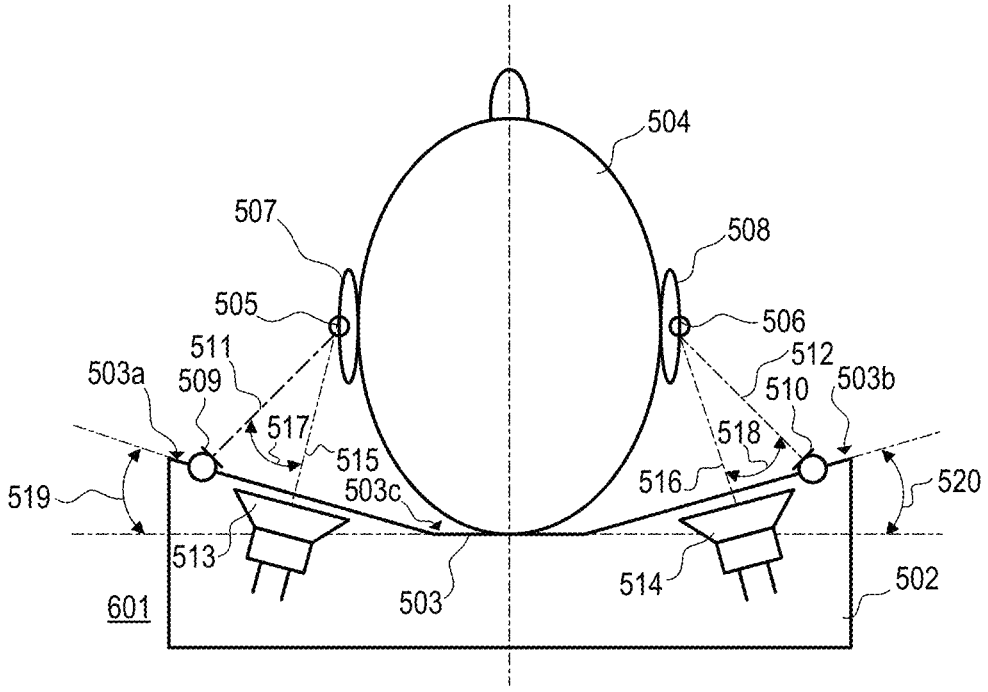
FIG. 6 is a schematic diagram of an exemplary headrest in which microphones and loudspeakers are integrated side by side in a front surface of the headrest, the microphones being arranged towards a periphery of the headrest and the loudspeakers being arranged towards a center of the headrest.

An exemplary headrest 601 shown in FIG. 6 is similar to headrest 501 shown in FIG. 5, however, the microphone positions and loudspeaker positions have been reversed and all positions have been shifted towards the outer peripheries of planar end sections 503*a* and 503*b* of front surface 503. Loudspeakers 513 and 514 are arranged such that their principal transmitting directions 515 and 516 have angles 517 and 518 at preferential positions 505 and 506 of greater than 30 degrees with regard to the respective principal receiving direction of microphones 509 and 510.

Figure 7:
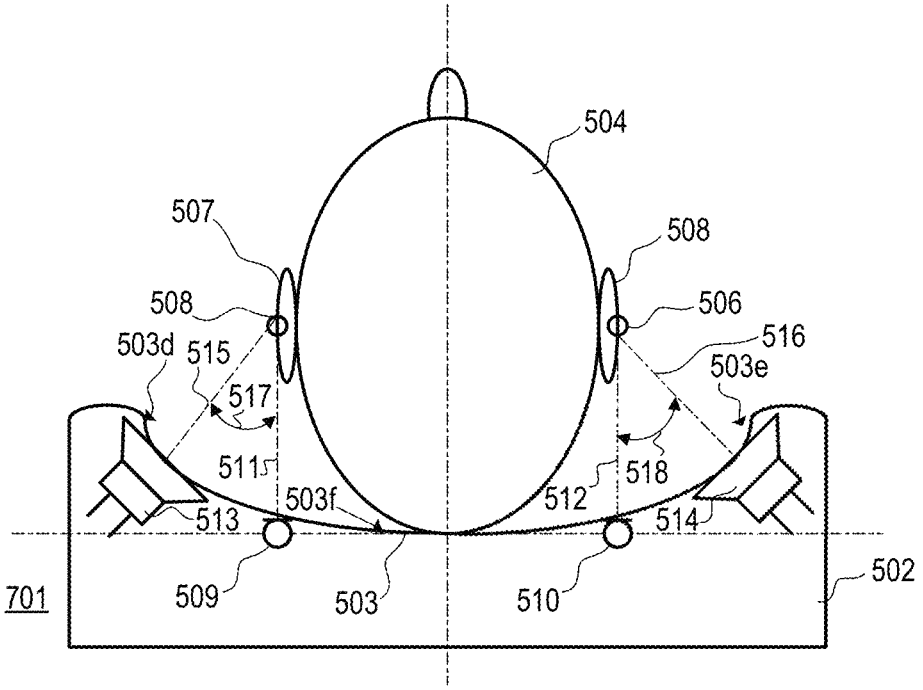
FIG. 7 is a schematic diagram of an exemplary headrest in which microphones and loudspeakers are integrated in a concave-shaped rounded front surface of the headrest, the microphones being arranged towards a center of the headrest and the loudspeakers being arranged towards a periphery of the headrest and elevated with regard to the microphones.

An exemplary headrest 701 shown in FIG. 7 is similar to headrest 501 shown in FIG. 5, however, front surface 503 of the headrest 701 has an inward-curving, rounded shape extending much further around the longitudinal axis of head 504, and it has curved end sections 503*d* and 503*e* and a curved intermediate section 503*f*. Loudspeakers 513 and 514 are arranged in peripheral sections 503*d* and 503*e* of headrest 501 and thus have a more laterally protruding level from intermediate section 503*f* of surface 503 than in the previous examples. Microphones 509 and 510 are positioned almost directly behind the user's ears 507 and 508. Accordingly, loudspeakers 513 and 514 are arranged such that their principal transmitting directions 515 and 516 have angles 517 and 518 at preferential positions 505 and 506 of greater than 45 degrees with regard to the respective principal receiving direction of microphones 509 and 510.

Figure 8:
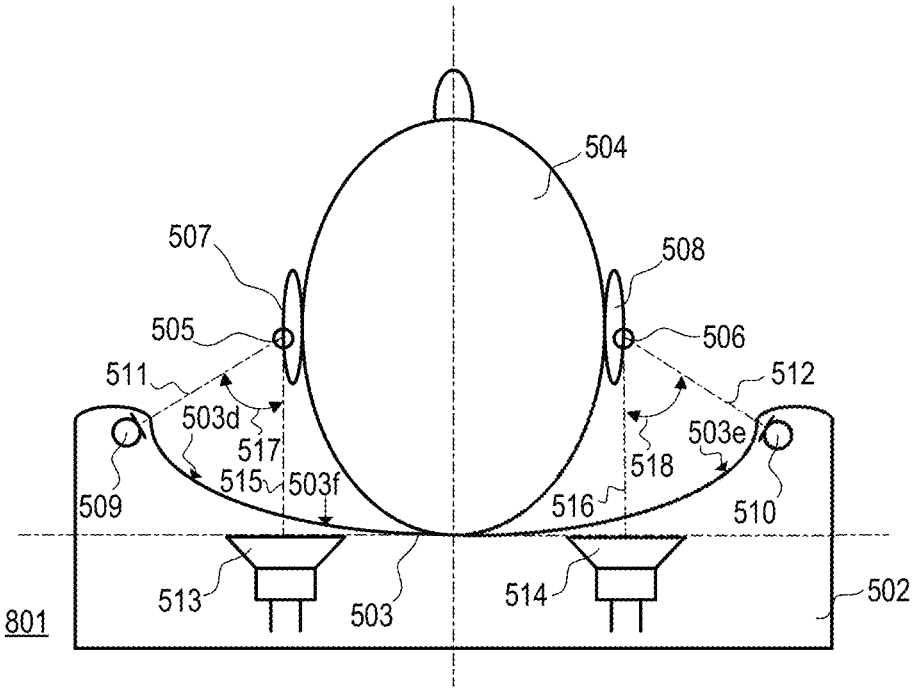
FIG. 8 is a schematic diagram of an exemplary headrest in which microphones and loudspeakers are integrated in a concave-shaped rounded front surface of the headrest, the loudspeakers being arranged towards a center of the headrest and the microphones being arranged towards a periphery of the headrest and elevated with regard to the loudspeakers.

Headrest 801 shown in FIG. 8 is similar to headrest 501 shown in FIG. 7, however, the microphone positions and loudspeaker positions are reversed and the positions of the microphones have been shifted towards the outer peripheries of curved end sections 503*d* and 503*e* of front surface 503. In the examples shown in FIGS. 5 to 8, two quiet zones are established around the preferential positions 505 and 506.

The description of embodiments has been presented for purposes of illustration and description. Suitable modifications and variations to the embodiments may be performed in light of the above description or may be acquired by practicing the methods. For example, unless otherwise noted, one or more of the described methods may be performed by a suitable device and/or combination of devices. The described associated actions may also be performed in various orders in addition to the order described in this application, in parallel, and/or simultaneously. The described systems are exemplary in nature, and may include additional elements and/or omit elements.

As used in this application, an element or step recited in the singular and preceded by the word "a" or "an" should be understood as not excluding the plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

The embodiments of the present disclosure generally provide for a plurality of circuits, electrical devices, and/or at least one controller. All references to the circuits, the at least one controller, and other electrical devices and the functionality provided by each, are not intended to be limited to encompassing only what is illustrated and described herein. While particular labels may be assigned to the various circuit(s), controller(s) and other electrical devices disclosed, such labels are not intended to limit the scope of operation for the various circuit(s), controller(s) and other electrical devices. Such circuit(s), controller(s) and other electrical devices may be combined with each other and/or separated in any manner based on the particular type of electrical implementation that is desired.

It is recognized that any system as disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any system as disclosed may utilize any one or more microprocessors to execute a computer-program that is embodied in a non-transitory computer readable medium that is programmed to perform any number of the functions as disclosed. Further, any controller as provided herein includes a housing and a various number of microprocessors, integrated circuits, and memory devices, (e.g., FLASH, random access memory (RAM), read only memory (ROM), electrically programmable read only memory (EPROM), and/or electrically erasable programmable read only memory (EEPROM).

While various embodiments of the invention have been described, it will be apparent to those of ordinary skilled in the art that many more embodiments and implementations are possible within the scope of the invention. In particular, the skilled person will recognize the interchangeability of various features from different embodiments. Although these techniques and systems have been disclosed in the context of certain embodiments and examples, it will be understood that these techniques and systems may be extended beyond the specifically disclosed embodiments to other embodiments and/or uses and obvious modifications thereof.

The invention claimed is:

1. An active road noise control system for a vehicle, the system comprising:

a noise sensing microphone array configured to generate a multiplicity of noise sense signals representative of road noise originating from a road noise source in or at the vehicle, the noise sensing microphone array comprising a multiplicity of microphones disposed at a multiplicity of positions in or on the vehicle, wherein the noise sensing microphone array includes at least three microphones that are arranged in a line or plane;

a beamformer configured to process the multiplicity of noise sense signals to generate a reference signal and to provide in connection with the noise sensing microphone array a sensitivity characteristic that comprises a main lobe directed to a predetermined region of a wheel that is the road noise source;

an active road noise control filter configured to iteratively and adaptively process the reference signal to provide a noise reducing signal; and a loudspeaker arrangement disposed in an interior of the vehicle and configured to generate, from the noise reducing signal, noise reducing sound at a listening position in the interior of the vehicle, the loudspeaker arrangement comprising one or more loudspeakers.

2. The system of claim 1, further comprising:

an error microphone arrangement configured to pick up sound at or close to the listening position and to provide an error signal representative of the picked-up sound;

wherein, the error microphone arrangement comprises one or more microphones; and the active road noise control filter is further configured to iteratively and adaptively process the reference signal and the error signal to provide the noise reducing signal.

3. The system of claim 1, further comprising:

a headrest disposed in a vicinity of the listening position;

wherein, at least one of: one or more loudspeakers of the loudspeaker arrangement and one or more microphones of the error microphone arrangement are disposed at, on or in the headrest.

4. The system of claim 1, further comprising at least one additional noise sensing microphone array and at least one additional beamformer, wherein the at least one additional beamformer is configured to provide in connection with the at least one additional noise sensing microphone array at least one additional sensitivity characteristic that comprises a main lobe.

5. The system of claim 4, wherein the main lobe of the at least one additional sensitivity characteristic is directed towards a further predetermined region of the wheel that is the road noise source, wherein the predetermined region of the wheel that is the road noise source is a wheel hub of the wheel, and wherein the further predetermined region of the wheel that is the road noise source is a boundary of the wheel and a road surface.

6. The system of claim 1, wherein the sensitivity characteristic provided in connection with the noise sensing microphone array comprises additional lobes positioned on either side of the main lobe.

7. The system of claim 6, wherein each of the additional lobes has a lower sensitivity than a sensitivity of the main lobe.

8. The system of claim 7, wherein the main lobe extends directly towards the predetermined region of the wheel that is the road noise source, and wherein the additional lobes are angled outwardly away from the main lobe.

9. An active road noise control method for a vehicle, the method comprising:

picking up noise at a multiplicity of positions in or on the vehicle and generating a multiplicity of noise sense signals representative of road noise originating from a road noise source in or at the vehicle, wherein the noise sensing microphone array includes at least three microphones that are arranged in a line or plane;

processing according to a beamforming scheme the multiplicity of noise sense signals to generate a reference signal and to provide a sensitivity characteristic for picking up the noise that comprises a main lobe directed to a predetermined region of a wheel that is the road noise source;

iteratively and adaptively processing the reference signal to provide a noise reducing signal; and generating at one or more positions in an interior of the vehicle, from the noise reducing signal, noise reducing sound at a listening position in the interior of the vehicle.

10. The method of claim 9, further comprising:

picking up sound at or close to the listening position and providing an error signal representative of the picked-up sound;

wherein, the sound is picked up at one or more positions at or close to the listening position; and wherein, the reference signal and the error signal are iteratively and adaptively processed to provide a noise reducing signal to provide the noise reducing signal.

11. The method of claim 9, wherein at least one of: generating, from the noise reducing signal, the noise reducing sound and picking up sound at or close to the listening position to provide the error signal takes place at, on, or in a headrest disposed in a vicinity of the listening position.

12. The method of claim 9, further comprising:

picking up noise at a multiplicity of additional positions in or on the vehicle and generating a multiplicity of additional noise sense signals representative of road noise occurring in or at a wheel of the vehicle; and processing according to an additional beamforming scheme the multiplicity of additional noise sense signals to generate an additional reference signal and to provide an additional sensitivity characteristic for picking up the noise that comprises a main lobe.

13. The method of claim 9, wherein the beamforming scheme is a delay and sum beamforming scheme.

14. The method of claim 9, wherein in addition to the main lobe, the sensitivity characteristic for picking up the noise comprises a multiplicity of side lobes, wherein at least one of the multiplicity of side lobes is positioned on each side of the main lobe.

15. The method of claim 9, wherein the predetermined region of the wheel that is the road noise source is a wheel hub of the wheel.

16. A vehicle comprising an active road noise control system wherein the system comprises:

a noise sensing microphone array configured to generate a multiplicity of noise sense signals representative of road noise originating from a road noise source in or at the vehicle, the noise sensing microphone array comprising a multiplicity of microphones disposed at a multiplicity of positions in or on the vehicle, wherein the noise sensing microphone array includes at least three microphones that are arranged in a line or plane;

a beamformer configured to process the multiplicity of noise sense signals to generate a reference signal and to provide in connection with the noise sensing microphone array a sensitivity characteristic that comprises a main lobe directed to a predetermined region of a wheel that is the road noise source;

an active road noise control filter configured to iteratively and adaptively process the reference signal to provide a noise reducing signal; and a loudspeaker arrangement disposed in an interior of the vehicle and configured to generate, from the noise reducing signal, noise reducing sound at a listening position in the interior of the vehicle, the loudspeaker arrangement comprising one or more loudspeakers.

17. The system of claim 16, wherein the noise sensing microphone array is arranged in an arch of the wheel and provides the sensitivity characteristic that includes the main lobe and a multiplicity of additional lobes, and wherein the main lobe is directed to only one noise source.

18. The system of claim 17, further comprising an additional noise sensing microphone array located at the arch of the wheel.

19. The system of claim 18, wherein the noise sensing microphone array is positioned in the arch above the wheel, and wherein the additional noise sensing microphone array is positioned at the arch behind the wheel.

20. The system of claim 16, wherein the noise sensing microphone array that includes at least three microphones arranged in the line or plane includes at least five microphones, wherein the sensitivity characteristic provided in connection with the noise sensing microphone array includes at least five lobes, the at least five lobes comprising one main lobe, at least two side lobes positioned on a first side of the one main lobe, and at least two further side lobes positioned on a second side of the main lobe, and wherein the one main lobe is the main lobe that is directed to the predetermined region of the wheel that is the road noise source.

* * * * *